United States Patent [19]

Ginsberg

[11] 4,132,406

[45] Jan. 2, 1979

[54] WORD GAME

[76] Inventor: Kurt Ginsberg, 20 W. 64th St., New York, N.Y. 10023

[21] Appl. No.: 746,089

[22] Filed: Nov. 30, 1976

[51] Int. Cl.[2] ..... A63F 1/10

[52] U.S. Cl. ..... 273/1 R; 273/272

[58] Field of Search ..... 273/1 R, 1 E, 1 M, 152.7 R, 273/152.7 A, 130 E, 131 G, 134 AB, 135 D, 136 N; 35/71, 35 J

[56] References Cited

U.S. PATENT DOCUMENTS

| | | | |
|---|---|---|---|
| 1,685,723 | 9/1928 | Robins | 273/152.7 A |
| 2,265,334 | 12/1941 | Ambruster | 35/35 J X |
| 2,824,741 | 2/1958 | Wiley | 273/152.7 A |
| 3,678,602 | 7/1972 | Alam | 35/71 X |

OTHER PUBLICATIONS

Selchow & Righter 100th Anniversary Catalog p. 15 "Scrabble" 3/14/68.

*Primary Examiner*—Paul E. Shapiro

*Attorney, Agent, or Firm*—Steinberg & Blake

[57] ABSTRACT

A word game wherein the letters of the alphabet are distributed among a number of bodies each of which carries only one letter of the alphabet with some of the bodies being duplicates so that certain letters appear on more than one body. These bodies are coded so as to form different types of bodies, and one group of letters of the alphabet are situated only on bodies of one type, while another group of letters of the alphabet are situated only on bodies of another type, the different types of bodies being readily visible to the players so that a player viewing a body of a given type will know that the particular body carries a letter of a given group. A support structure is provided for supporting a selected row of bodies the letters of which form a selected word, and a covering structure is provided for covering the letters of the selected row of bodies on the support structure, so that a player can see only the types of the bodies and not the letters thereon, in order to attempt to guess the word covered by the covering structure. If a player cannot guess the particular word, then he may request that a certain one of the bodies be shifted with respect to the covering structure so as to render the letter on the shifted body visible, and in this way a player can receive a further hint as to what the word is.

10 Claims, 7 Drawing Figures

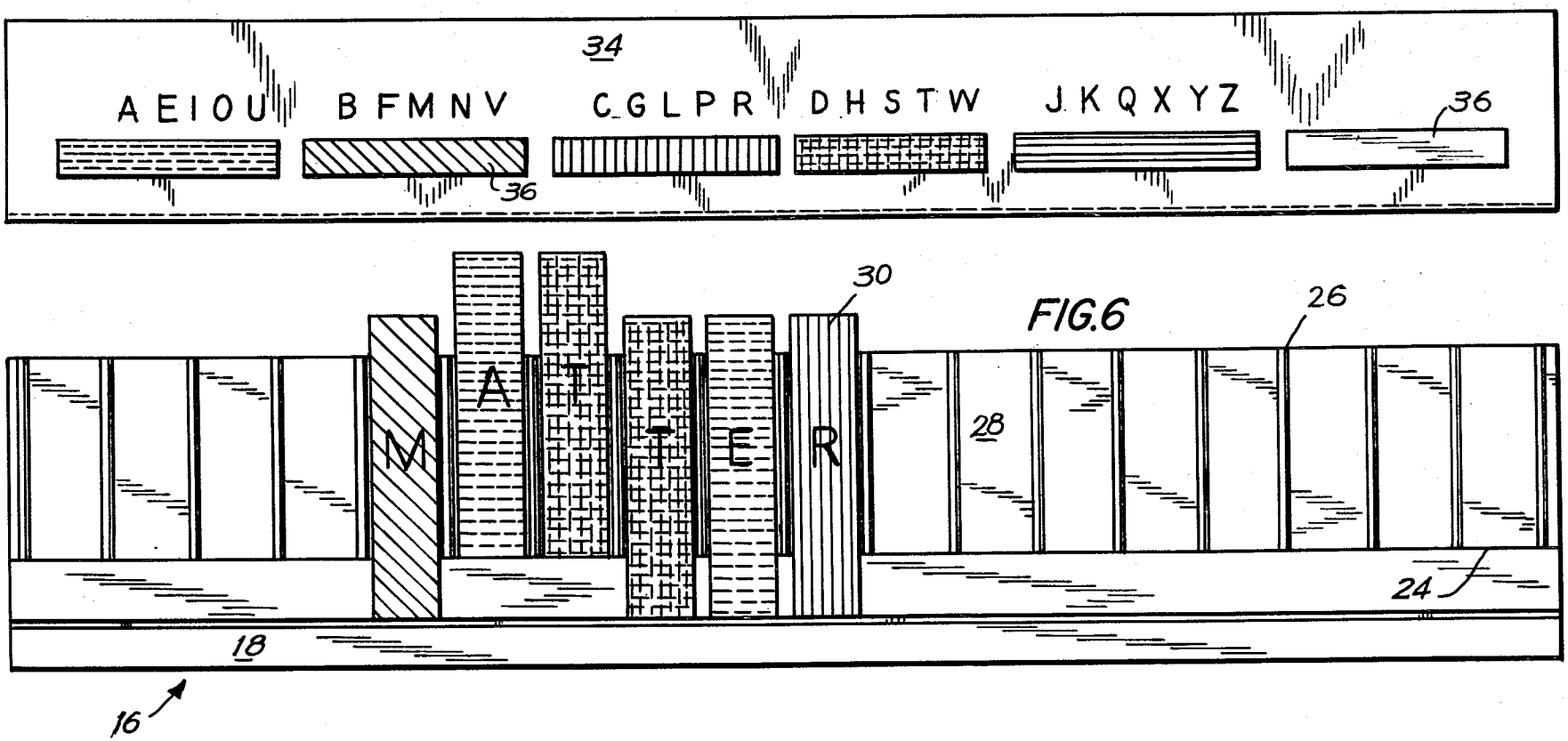
A E I O U
B F M N V
C G L P R
D H S T W
J K Q X Y Z
34
36
36
FIG.5
26
24
28
30
R
E
T
A
N
18
16
FIG.6
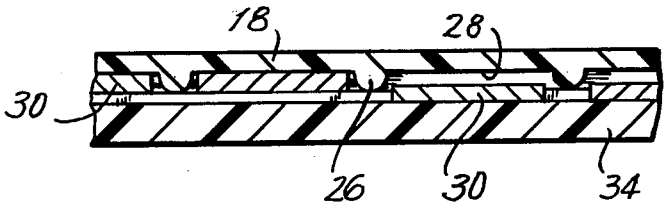
34
28
30
26
18
30
FIG.7

WORD GAME

BACKGROUND OF THE INVENTION

The present invention relates to word games.

At the present time, there are many types of known word games according to which, for example, a player is required to build up words from certain letters or a player is required to continue a series of letters to continuously form words therefrom with each player adding a letter to a given word during formation thereof.

Thus, while word games of the above general type are indeed known, these known word games lack certain highly desirable characteristics for a game. For example, conventional word games commonly lack the element of competition between players. In other words each player acts independently in a conventional word game of the above general type without necessarily pitting his knowledge against the knowledge of another player. Also, conventional word games are exceedingly complex and expensive, so that considerable costs are involved in order to provide conventional word games. Also, while word games are known according to which separate letters are added to previous letters placed on a board according to a given arrangement, the conventional word games do not make use of the characteristics of words of a given language according to which certain letters frequently appear in combination in many words. Moreover, conventional word games lack the capability of handicapping certain highly skilled players so that the possibilities of success of a given player of great ability can be equated with the possibilities of success of a player of lesser ability.

SUMMARY OF THE INVENTION

It is accordingly a primary object of the present invention to provide a word game which will avoid the above drawbacks.

In particular, it is an object of the present invention to provide a word game which is composed of relatively simple inexpensive components, so that without requiring a high cost it is possible for the word game of the invention to be utilized by people of modest means.

Furthermore, it is an object of the present invention to provide a word game which is capable of placing a pair of players directly in competition with each other.

Also, it is an object of the present invention to provide a word game according to which advantage is taken of the fact that certain letters of the alphabet equally appear in combination in many words.

In addition it is an object of the present invention to provide a word game which is capable of equating the possibilities of success among players of different abilities.

In addition it is an object of the present invention to provide a word game made up of simple rugged elements which will have a long useful life and which can be easily manipulated by the players.

Furthermore it is an object of the present invention to provide a word game which can be played by two or more players.

Yet another object of the invention is to provide a word game which can be played by all age groups and by people of all degrees of intelligence and educational background.

According to the invention the word game includes a plurality of bodies each of which has thereon only one letter of the alphabet, the letters of the alphabet being distributed among the several bodies with certain bodies being duplicates so that certain letters appear on more than one body. The bodies are coded into different types of bodies, with the different types being visibly apparent to a player, and all of the letters of a given group of letters belong to one of the coded types, while all of the letters of another group belong to another of the coded types of bodies. Thus a player viewing a body, without seeing the letter thereon, will know that the body belongs to a certain type so that a letter of a given group must be on the body of the particular type. For example, the bodies can be color-coded so that different bodies are designated by different colors, and one group of letters will belong to bodies of one color while another group of letters will belong to bodies of another color. A support means is provided for supporting a selected row of bodies which form a selected word, and a cover means is capable of covering the row of bodies on the support means in such a way that the letters of the row of bodies are not visible while the types of bodies are visible, so that a player viewing the covered row of bodies will know that each body belongs to a given type and therefore has a certain letter of a group of letters thereon, but the practice word will not be known to the player who is attempting to guess the word. If a player cannot guess the word immediately, then this player can request that a certain one of the bodies be shifted with respect to the cover means so as to render the letter of a selected body visible, and thus a player can receive a further hint as to the particular word selected by an opposing player.

BRIEF DESCRIPTION OF DRAWINGS

The invention is illustrated by way of example in the accompanying drawings which form part of this application and in which;

FIG. 5 illustrates a cover means of the invention having thereon an indicating means which indicates the code of the particular word game illustrated;

FIG. 6 is an illustration of a support means of the invention having thereon selected bodies which form a given word, the support means of FIG. 6 being adapted to support the cover means of FIG. 5; and FIG. 7 is a fragmentary longitudinal section of the structure of FIG. 3 taken along line 7—7 of FIG. 3 in the direction of the arrows.

DESCRIPTION OF PREFERRED EMBODIMENTS

Figure 1:
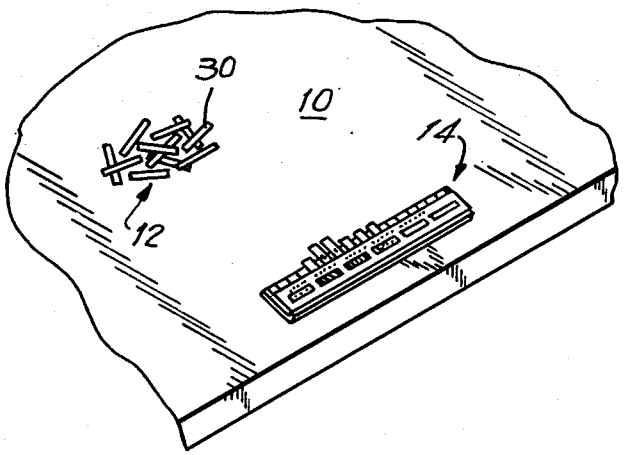
FIG. 1 is a fragmentary perspective illustration of a table on which the components of one possible embodiment of a game according to the present invention are situated.

Referring to FIG. 1, there is fragmentarily illustrated therein a table 10 at which at least a pair of players can conveniently be seated for playing the word game of the invention. FIG. 1 illustrates on the table 10 a pile of bodies 12 which are haphazardly situated on the table so as to be convenient to the players. FIG. 1 also shows on the table 10 the structure 14 of one possible embodiment of the invention, this structure 14 being situated in front of the player who is attempting to guess a word selected by another player, in a manner described in greater detail below.

The structure 14 includes, as shown most clearly in FIG. 6, a support means 16 in the form of an elongated sheet 18 made of any suitable plastic, metal, wood, or similar substantially rigid sheet material. This sheet 18 of the support means 16 is fixed at its lower surface to at least a pair of substantially triangular members 20 shown most clearly in FIGS. 3 and 4. These members 20 have bottom edges resting on the surface of the table 10 and inclined edges fixed to the lower surface of the sheet 18 in the manner apparent from FIGS. 3 and 4. Thus, at least a pair of these members 20 are spaced from each other while being fixed to the lower surface of the sheet 18 inwardly of the ends thereof, or even at the ends thereof, so that by way of these members 20 the sheet 18 can be supported in a stable manner on the table 10 with the sheet 18 being inclined as illustrated so that its upper surface is conveniently visible to a player. In the particular example illustrated the lower right angle of member 20 shown in FIGS. 3 and 4 may be 30°, but of course the member 20 can also be in the form of an isosceles right triangle with this angle being 45°, if desired.

The sheet 18 of the support means 16 is provided at its upper surface with a lower stepped shoulder 22 and with an upper shoulder 24, these shoulders 22 and 24 being parallel to each other and extending horizontally across the sheet 18 longitudinally thereof, this sheet 18 having a uniform cross section along its entire length.

Just above the upper shoulder 24 the sheet 18 carries a plurality of guide members 26 shown most clearly in FIG. 6. Thus, these guide members 26 are in the form of ribs fixed to and projecting from the upper surface of the sheet 18 above the upper shoulder 24 thereof, and these ribs 26 are parallel to each other and perpendicular to the shoulder 24. The ribs 26 have a depth substantially equal to the depth of the shoulder 24 so that the uppermost surfaces of the ribs 26 are in the same plane as that part of the sheet 18 which extends between the shoulders 22 and 24. The several guide members 26 define between themselves spaces 28 for receiving parts of bodies 30 of the invention as described below. Some of the bodies 30 of the invention are indicated in FIG. 6. In FIG. 1 there is shown a pile 12 of bodies 30 which are haphazardly arranged, as indicated above.

Figure 2:
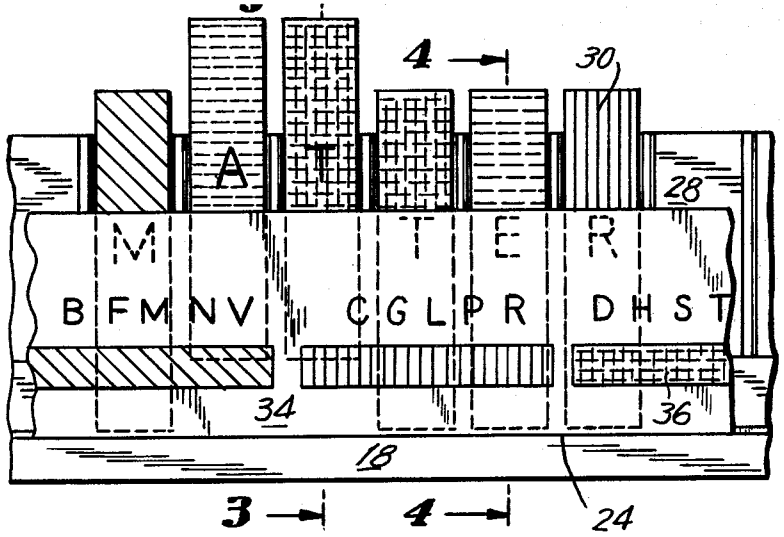
FIG. 2 is a fragmentary front elevation of that part of the game structure of FIG. 1 where a row of bodies are situated to form a selected word, the structure being shown in FIG. 2 at a scale which is considerably enlarged as compared to FIG. 1.

According to the invention each of the several bodies 30 has front and rear surfaces and each carries at its front surface only one letter of the alphabet. Thus each body 30 may be in the form of a substantially rigid strip of cardboard or suitable plastic material, for example, having the elongated rectangular configuration apparent from the drawings. Each body 30 has imprinted thereon, for example, between its opposed ends and on its front surface a letter of the alphabet as is apparent from FIGS. 2 and 6. All of the letters of the alphabet are distributed among the bodies 30, and in addition some of these bodies 30 are duplicates so that certain letters appear more than once on different bodies 30.

Figure 4:
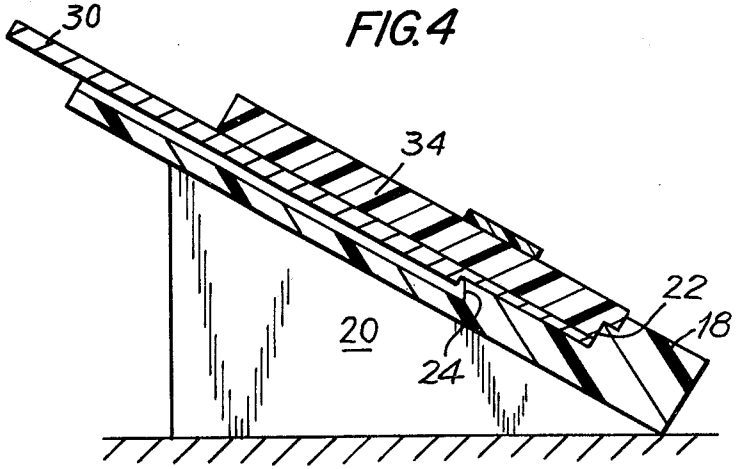
FIG. 4 is a transverse section of the structure of FIG. 2 taken along line 4—4 of FIG. 2 in the direction of the arrows.
Figure 3:
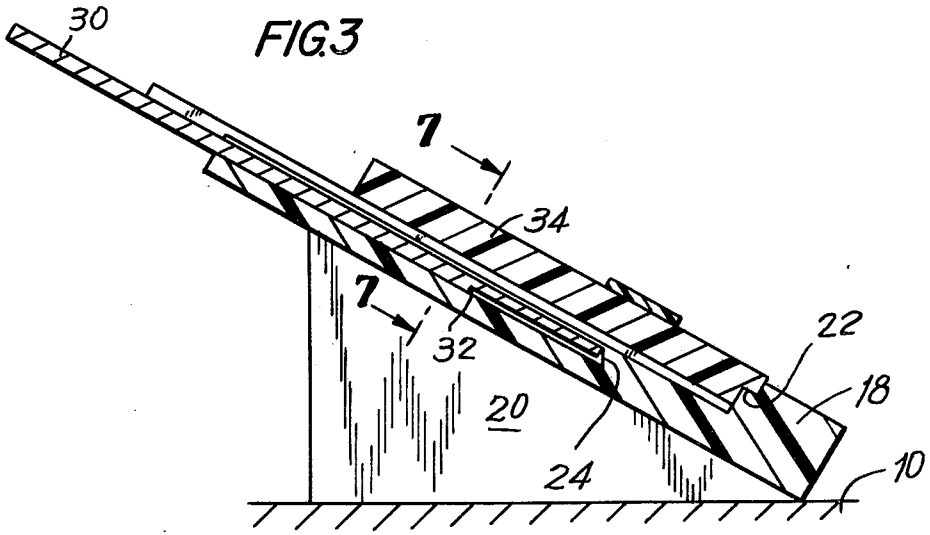
FIG. 3 is a transverse section of the structure of FIG. 2 taken along line 3—3 of FIG. 2 in the direction of the arrows.

As is apparent from FIGS. 3 and 4, each body 30 has in the region of its lower end, as viewed in FIGS. 3 and 4, a thickness which is less than the thickness of the body beyond this lower end region, so that each body 30 has at its underside a transverse shoulder 32. Initially the bodies 30 are situated as shown in FIG. 4 with the shoulders 32 of the selected bodies 30 engaging the shoulder 24. With the bodies situated in this manner, as indicated in FIG. 4 and at the right portion of FIG. 2, it is possible to cover the bodies with a cover means in the form of a second elongated sheet 34 which may be made of the same material as the sheet 18. Thus, while the selected bodies engage 18 of the support means with their rear surfaces, the cover means 34 is situated next to the front surfaces of the selected bodies. This cover means 34 has in the region of its lower edge a shoulder for cooperating with the shoulder 22 in the manner most clearly apparent from FIGS. 3 and 4. When the bodies 30 are in the position of FIG. 4 and the cover means 34 is situated over the bodies 30 and on the sheet 18, the cover means 34, which is opaque, will cover the letters of a row of bodies situated on the support means 18. Thus, referring to FIG. 2 it will be seen that a player has selected the word "matter," and in the position of the part shown in FIG. 2 the first letter and the last three letters of this word are invisible, being indicated in dotted lines in FIG. 2. However, the second and third bodies of FIG. 2 have been shifted to the position of FIG. 3, thus rendering the letters of these bodies visible above the cover means 34, as is apparent from FIG. 2. It will be noted that the width of the elongated bodies 30 is such that these bodies are conveniently received in the spaces 28 so as to be guided between the guide members 26 for longitudinal shifting movement between the positions of FIGS. 3 and 4. Thus, the parts can be initially arranged as shown in FIG. 4 with all of the bodies 30 of a selected row situated in their lower positions, and then certain bodies can be shifted with respect to the cover means 34 to the upper position shown for the second and third bodies of FIG. 2, with the bodies being guided by the guides 26 during such shifting.

According to a particular feature of the invention, the bodies 30 are coded so as to form different types of bodies. In the particular example illustrated, a color coding is utilized. Thus, certain bodies will have a gray color, certain bodies will be green, certain bodies will be red, etc. In accordance with this particular feature of the invention, the letters of the alphabet are divided into groups with all of the letters of one group belonging to one type of body. In the particular example illustrated, the cover means 34 has at its outer surface which is visible an indicating means indicating the code. This code is apparent in FIG. 5 which illustrates the outer surface of the cover means 34. Thus it will be seen from FIG. 5 that at the left there is indicated a group including all of the vowels, these vowels being coded in such a way as to be designated by the gray color. Thus all bodies 30 which have a gray color carry a vowel. The next group of five letters shown in FIG. 5 are coded so as to be on green bodies 30, and thus when a player sees a green body he knows that particular body carries one of the letters of the second group. The third group from the left in FIG. 5 includes five letters situated on red bodies, while the following group of five letters are situated on yellow bodies, and the final group of six letters are situated on blue bodies, with a blank or white designation being provided at the right of FIG. 5 by the elongated strip 36 shown at the right of FIG. 5. Thus the several areas 36 in FIG. 5 may be printed or otherwise provided at the outer surface of the cover means 34, and above the differently colored areas 36 are situated the various groups of letters of the alphabet corresponding to the different colors as indicated in FIG. 5.

It is to be noted that in accordance with the invention not only do all of the vowels form one group, but in addition the particular letters of the different groups have a certain relationship to each other. Thus, the last group of letters appearing in FIG. 5 are seldom-used letters. In the other groups are situated letters which often appear in combination. Thus in the fourth group from the left in FIG. 5 it will be seen that there are in this particular group letters such as "st," "sh," "wh," all of which are combinations of letters which are very often used together in English words. The same considerations apply to the third group from the left in FIG. 5 where the letters "pl," "pr," "cl," and "gl," form groups which are frequently encountered in English words. The second group from the left in FIG. 5 includes letters which do not frequently appear in given combinations although these letters may be frequently used.

Thus, as pointed out above, while all of the letters of the alphabet respectively appear on the different bodies 30, some of these bodies are duplicates and thus enable certain letters to appear more than once on given bodies, as is apparent from the third and fourth bodies appearing in FIG. 6. Moreover, some bodies are blank for a purpose referred to below and these bodies are white, corresponding to the right strip 36 shown in FIG. 5.

The number of bodies 30 and the distribution of the letters of the alphabet among the bodies can be provided in accordance with the frequency with which the letters appear in different words and the number of players. For example where a game is to be played by four players, it has been found convenient to provide only two bodies for seldom used letters such as "j," "k," "w," and "z." For letters such as "q" and "x", only one body need be provided. On the other hand, certain frequently used letters will appear on several bodies. For example nine of the bodies may have thereon the letter "e," and the remaining vowels can appear on each of five or six bodies. Letters such as "b," "f," "m," may appear on each of three bodies, and letters such as "c," "g," may appear on each of four bodies, and so on. In the above manner the pile 12 may include, for example, ninety six bodies 30 having the letters of the alphabet distributed on these bodies approximately as indicated above, depending upon the frequency with which the particular letters are likely to appear in words of the language. In addition, there may be, for example, fourteen blank bodies which are white as designated by the right strip 36 of FIG. 5.

The various bodies 30 may, for example, have a width on the order of ½ inch, and a length on the order of 1½ inch, while the thickness may be on the order of 0.060 inch, except for the thinner lower regions as referred to above, providing each body at its rear surface with the shoulder 32.

In order to play the game one player will select from the pile 12 bodies 30 which make up a certain word, this being the word "matter" in the example illustrated. Of course this selection is made by one player while the other player cannot see the particular word which is being selected. The player selecting the word places the bodies 30 on the support means 16 in the manner shown for the first and last three letters of the word indicated in FIG. 6, and then the cover means 34 is placed on the support means so that the structure will have the condition shown in FIG. 2, except for the second and third letters. At this time all of the letters of the selected word are hidden, and once a player has set up the game in this manner he presents the structure 14 to the opposing player. This opposing player in the meantime goes through the same procedure with a duplicate of the above structure 14 which this other player presents to the first player, and then both players attempt to guess the words, a certain time limit being provided. It will be noted that at this time the colors of the bodies 30 are visible while the letters thereon are invisible, so that a player guesses the word according to the code which is indicated at the outer surface of the cover means 34. Thus, a player will note from the colors of the bodies 30 that certain of these bodies include vowels while other bodies belong to certain types which have letters of a given group thereon. Initially a player may take a wild guess as to the particular word. Of course each player selects words having the same number of letters therein, so that the difficulties encountered by the pair of opposing players are equal. Assuming that neither player guesses the other player's word during the first interval of two minutes, for example, then each player may select to have one of the bodies 30 displaced from its lower position to its upper position, this upper position being shown for the second and third bodies 30 in FIG. 6, as well as in FIG. 2. In this way the players may after intervals of two minutes, for example, have different bodies 30 displaced to their upper positions displaying the letters thereon, until the particular word is guessed by a given player, and then any suitable score may be kept between the players. It is to be noted, for example, that with the position of the parts shown in FIGS. 2 and 6, although the second and third letters are apparent, the word still may not be known since a player may guess that the word is "batter" rather than "matter." Moreover, if, for example, the first and fourth letters have been selected to be raised to illustrate the letters thereon, the word might be "master" or "mister," so that it is apparent that certain words cannot be readily guessed by a player. In this way the game can progress with any suitable score being kept or any suitable chips being used in any desired manner for keeping score.

Where a player is superior to other players, it may be desired to give such a player a handicap. For this purpose the poorer player includes one or more blank bodies in the word to be guessed by the superior player. In this event such a player will be required to guess letters at spaces occupied by blank bodies which can represent any desired letter. The poorer player writes the word to be guessed on a slip which the superior player cannot see and which is, for example, hidden from the view of the superior player. For example if such a blank body is used for the third letter in the particular word shown in FIGS. 2 and 6, then this third letter can be any letter of the alphabet so that if the superior player guesses "master" rather than "matter," such a player has not guessed the word. When the word is finally guessed by the superior player, the poorer player will show him the word written on the slip so as to assure the superior player that the poorer player has not changed the word during the effort by the superior player to guess the word. Of course, the superior player can "give up" and suffer a certain penalty, at which point the poorer player will of course show the superior player the word written on the slip.

Of course, words much longer than six-letter words may be used, and any given word may have more than one blank body representing letters, so that the extent of handicap can be varied.

When the bodies are in their lower position with the letters thereof hidden by the cover means 34, the bodies are reliably held on the support means 18 by the cover means 34 in the manner apparent from FIG. 4 where the thinner portions of the body are situated between the cover means 34 and that part of the support means 18 between the shoulders 22 and 24 thereof. When a body is shifted so as to render the letters thereof visible, then the lower edge of the body will engage the shoulder 24 in the manner shown in FIG. 3, and the body will be situated in a space 28, so as to remain reliably in the raised position indicated for the second and third letters in FIGS. 2 and 6.

Of course, many variations are possible with respect to the structure used. For example the selected bodies 30 can simply be arranged in a row directly on the surface of the table 10 without having any particular support means 18 beyond the table 10 itself, and the cover 34 can be situated over such a row of bodies resting directly on the table 10. However, the arrangement shown in the drawings is preferred since the particular support means 16 renders the selected row of bodies conveniently visible and easy to manipulate while at the same time the players need not change their positions and can easily transfer the structure 14 from one player to another. Thus, where four players compete against each other, each player can set up a given word of a given number of letters on a structure 14 and then shift his structure 14 to the player at his right, for example, and then the guessing can go forward. Moreover, the indication of the code need not be on the outer surface of the cover means 34. Any suitable cards may be separately provided for this purpose or the outer surface of the support means 16 may accommodate the indication of the particular code.

Furthermore, color coding is not absolutely essential. Any other type of coding may be utilized. For example the upper ends of the bodies 30 which are always visible may have different shapes to indicate the different coding. Thus, pointed upper ends may indicate bodies which have the vowels, convexly curved upper ends may form another coded type, concavely curved upper ends may form another type of code, bodies with upper right corners bevelled may form a code, and so on. However it is preferred to utilize the color coding since in this way all of the bodies have the same configuration and any fraying or damaging of the bodies at their edges will not disturb the code.

It is furthermore to be noted that the game is enhanced by the particular manner in which the groups of letters are set up according to the different codes. Thus in the fourth group from the left in FIG. 5 it will be seen that there are letters which are frequently used together. Where a pair of bodies 30 having this particular code indication are situated one next to the other, a player will know that while the two successive letters belong to this particular group, any relatively large number of combinations of these letters may be possible such as "st," rather than "tt," in the particular example illustrated. Thus in this way with the game of the invention particular skill is required to select words in such a way that according to the code any selected word provides different possibilities of a number of words, thus rendering the guessing of the particular word selected more difficult than would otherwise be the case.

While it is clear from the above that a particularly interesting game is provided, calling for direct competition between opposed players, and calling for considerable skill, at the same time the components which make up the game are simple and inexpensive and can be used almost indefinitely without any possibility of breakage or the like.

Also, it is clear that the game of the invention can be used with relatively short simple words as well as extremely long complex words. Thus it is possible for small children who are barely able to read to play the game of the invention, using simple words such as "cat," "dog," "table," "chair," and the like. On the other hand highly educated individuals with large vocabularies can also use the game of the invention when playing against each other, and in this case of course extremely long complex words can be utilized by such players. Thus, the game of the invention is not limited to any particular group or type of individual.

What is claimed is:

1. A word game comprising a plurality of bodies each having thereon a letter of the alphabet, with all of the letters of the alphabet being distributed among said bodies and with at least some of said bodies being duplicates, so that some letters appear on more than one body, said bodies being coded into different types of bodies in such a way that a given group of letters of the alphabet belong to one type of bodies which carry the letters of the latter group, while another group of letters of the alphabet belong to a different type of bodies which carry said letters of said other group, so that by noting the type of a body a player will know that the latter body carries one letter of a given group, support means for supporting a row of selected bodies which form a selected word, and cover means for covering the selected row of bodies to an extent sufficient for covering and rendering invisible the letters on the latter row of bodies while rendering the types thereof visible, so that a player viewing the covered row of bodies will know from the type-coding of the bodies that each of the latter bodies has a letter of a given group, said bodies of said selected row being separately shiftable on said support means with respect to said cover means for rendering the letter of a shifted body visible, so that a player who cannot guess the word hidden by said cover means can selectively have certain bodies of the row shifted to render the letters of the shifted bodies visible for providing hints which aid in the guessing of the word which initially is totally hidden by said cover means, said support means supporting the row of selected bodies at an angle with respect to vertical and horizontal planes according to which the row of bodies are conveniently visible to a player, and said support means including a substantially rigid sheet on which the bodies are placed and members situated beneath and fixed to said sheet for supporting the latter at said angle, said sheet having thereon guides defining between themselves spaces for receiving said bodies so that the latter are shiftable between said guides, said cover means being in the form of a second elongated sheet capable of resting on the sheet of said support means covering the bodies on said support means, said sheet of said support means having a shoulder for engaging a bottom edge of said sheet of said cover means to hold the latter at a given location with respect to said support means.

2. The combination of claim 1 and wherein said sheet of said support means has above said shoulder which engages said cover means at a bottom edge of the latter a second shoulder, and said bodies themselves having shoulders for engaging said second shoulder to determine the position of a body on said sheet of said support means, and said bodies when shifted with respect to said cover means to render a letter of a body visible engaging said second shoulder to remain in a position with respect to said cover means on said sheet of said support means where a letter of a shifted body is visible.

3. A word game comprising a plurality of bodies each having thereon a letter of the alphabet, with all of the letters of the alphabet being distributed among said bodies and with at least some of said bodies being duplicates, so that some letters appear on more than one body, said bodies being coded into different types of bodies in such a way that a given group of letter of the alphabet belong to one type of bodies which carry the letters of the latter group, while another group of letters of the alphabet belong to a different type of bodies which carry said letters of said other group, so that by noting the type of a body a player will know that the latter body carries one letter of a given group, support means for supporting a row of selected bodies which form a selected word, and cover means for covering the selected row of bodies to an extent sufficient for covering and rendering invisible the letters on the latter row of bodies while rendering the types thereof visible, so that a player viewing the covered row of bodies will know from the type-coding of the bodies that each of the latter bodies has a letter of a given group, said bodies of said selected row being separately shiftable on said support means with respect to said cover means for rendering the letter of a shifted body visible, so that a player who cannot guess the word hidden by said cover means can selectively have certain bodies of the row shifted to render the letters of the shifted bodies visible for providing hints which aid in the guessing of the word which initially is totally hidden by said cover means, said support means supporting the row of selected bodies at an angle with respect to vertical and horizontal planes according to which the row of bodies are conveniently visible to a player, and said support means including a substantially rigid sheet on which the bodies are placed and members situated beneath and fixed to said sheet for supporting the latter at said angle, said sheet having thereon guides defining between themselves spaces for receiving said bodies so that the latter are shiftable between said guides, said cover means being in the form of a second elongated sheet capable of resting on the sheet of said support means covering the bodies on said support means, said sheet of said cover means and said sheet of said support means respectively having outer surface portions visible to a player, and one of said surface portions carrying an indicating means which indicates the groups of letters which belong to the different types.

4. The combination of claim 3 and wherein said bodies are coded by colors so that the different types of said bodies are respectively indicated by different colors.

5. The combination of claim 4 and wherein said bodies are all of the same size and shape.

6. The combination of claim 3 and wherein all of the vowels of the alphabet form one of said groups.

7. The combination of claim 6 and wherein another of said groups is formed by letters of the alphabet which are seldom used.

8. The combination of claim 6 and wherein another of said groups includes letters which are frequently used in combination with each other.

9. The combination of claim 3 and wherein said plurality of bodies include at least one body which is blank and which is capable of being used for any letter to provide a handicap for a given player.

10. The combination of claim 9 and wherein said blank body is coded so as to form a type different from the other types of said bodies.

* * * * *